US009561890B2

(12) United States Patent
Denney

(10) Patent No.: US 9,561,890 B2
(45) Date of Patent: Feb. 7, 2017

(54) MERCHANDISE STORAGE CONTAINER WITH INTEGRATED TOOL

(71) Applicant: Wynalda Litho, Inc., Belmont, MI (US)

(72) Inventor: James Robert Denney, Walker, MI (US)

( * ) Notice: Subject to any disclaimer, the term of this patent is extended or adjusted under 35 U.S.C. 154(b) by 404 days.

(21) Appl. No.: 14/153,008

(22) Filed: Jan. 11, 2014

(65) Prior Publication Data

US 2014/0197053 A1 Jul. 17, 2014

Related U.S. Application Data

(60) Provisional application No. 61/751,792, filed on Jan. 11, 2013, provisional application No. 61/757,066, filed on Jan. 25, 2013.

(51) Int. Cl.

| | |
|---|---|
| ***B65D 69/00*** | (2006.01) |
| ***B65D 77/24*** | (2006.01) |
| ***B65D 5/42*** | (2006.01) |

(52) U.S. Cl.

CPC ..... *B65D 77/24* (2013.01); *B65D 5/4208* (2013.01)

(58) Field of Classification Search

CPC ..... B65D 77/24; B65D 5/4208

USPC .... 206/229, 484, 230, 231, 525, 525.1, 349, 206/784, 750, 746, 353, 362.4, 425, 449, 206/555, 450, 451, 576, 494; 229/116.1, 229/125.03, 223, 116.3, 118; 401/25

See application file for complete search history.

(56) References Cited

U.S. PATENT DOCUMENTS

| | | | | |
|---|---|---|---|---|
| 3,765,044 | A * | 10/1973 | Hanahan | A47L 13/52 15/104.8 |
| 5,096,057 | A * | 3/1992 | Yoo | B65D 85/109 206/85 |
| 5,601,230 | A * | 2/1997 | Bell | B65D 5/42 141/337 |
| 5,960,949 | A | 10/1999 | Wynalda, Jr. | |
| 6,845,865 | B2 | 1/2005 | Wynalda, Jr. | |
| 7,784,610 | B2 * | 8/2010 | Mason | C11D 17/049 156/230 |
| 8,899,413 | B2 * | 12/2014 | Pruett | B65D 73/0078 206/232 |
| 2004/0246386 | A1 * | 12/2004 | Thomas | B32B 7/06 348/818 |
| 2008/0017536 | A1 | 1/2008 | Wynalda, Jr. | |
| 2009/0194442 | A1 | 8/2009 | Wynalda, Jr. | |
| 2009/0288968 | A1 | 11/2009 | Wynalda, Jr. | |
| 2013/0098549 | A1 * | 4/2013 | Drage | B32B 27/40 156/308.6 |
| 2013/0175191 | A1 * | 7/2013 | Andrich | B31B 1/74 206/349 |

* cited by examiner

*Primary Examiner* — Jacob K Ackun
*Assistant Examiner* — Jenine Pagan
(74) *Attorney, Agent, or Firm* — Zollinger & Burleson Ltd.

(57) ABSTRACT

A merchandise storage container includes a tool that is used with the merchandise provided in the container. The tool is an integral part of the storage container until the user of the merchandise separates the tool from the container and uses it with the merchandise from the container. In one embodiment, a paperboard-based merchandise storage container having a storage chamber for flexible screen savers includes a squeegee that is integrally formed during the formation of the merchandise storage container. The squeegee is separable from the container after the user accesses the screen savers so that the user has a squeegee ready for the installation of the screen savers on a phone or tablet computer.

16 Claims, 10 Drawing Sheets

MERCHANDISE STORAGE CONTAINER WITH INTEGRATED TOOL

CROSS REFERENCE TO RELATED APPLICATIONS

This application claims the benefit of U.S. Provisional Patent Applications 61/757,066 filed Jan. 25, 2013 and 61/751,792 filed Jan. 11, 2013; the disclosures of both applications are incorporated herein by reference.

BACKGROUND OF THE DISCLOSURE

1. Technical Field

The disclosure generally relates to merchandise storage containers and, more particularly, to merchandise storage containers formed from a plurality of layers folded together particularly wherein the layers are paperboard material. Specifically, the disclosure relates to a folded merchandise storage container wherein the container is integrally formed with a tool that is used with the merchandise stored and sold in the container.

2. Background Information

Many people add thin protective screen savers to their smart phones and tablet computers. Most people who have undertaken the task of installing such a screen saver have found satisfactory completion of the task to be harder than it looks. The flexible nature of the light-weight screen saver combined with the adhesive ensures that the process of aligning the screen saver with the screen and evenly applying the screen saver to avoid air bubbles and wrinkles usually fails to some degree. The manufacturers of screen savers have designed their products or have found that some air bubbles and wrinkles can be eliminated by applying even pressure over the surface of the screen saver shortly after it has been initially applied to the screen. Such even pressure can be applied with a squeegee that is rigid enough to smooth the screen saver but smooth enough not to tear the screen saver material.

SUMMARY OF THE DISCLOSURE

The disclosure provides a merchandise storage container that includes a tool that is used with the merchandise provided in the container. The tool is an integral part of the storage container until the user of the merchandise separates the tool from the container and uses it with the merchandise from the container.

The disclosure provides a paperboard-based merchandise storage container having a storage chamber for flexible screen savers. The merchandise container includes a squeegee that is integrally formed during the formation of the merchandise storage container. The squeegee is separable from the container after the user accesses the screen savers so that the user has a squeegee ready for the installation of the screen savers on a phone or tablet computer.

The disclosure provides a container as described above wherein the squeegee is formed from a plurality of material layers.

The disclosure provides a container as described above wherein the storage chamber of the container is accessed through a major wall of the container to allow for easy removal of the screen savers and to provide access to the squeegee.

The disclosure also provides a method of using a storage container for screen savers wherein the method includes the step of separating a squeegee tool from the storage container.

The disclosure provides a container as described above wherein the storage chamber of the container is accessed through an end wall of the container to allow for easy removal of the screen savers and to provide access to the squeegee.

The container may be disposed in an outer sleeve and the container may be configured to be not readily separated from the outer sleeve. The container can be moved outwardly from the sleeve far enough to provide access to the integrated tool.

The integrated tool may be carried by a door that covers the open end of the storage chamber.

BRIEF DESCRIPTION OF THE DRAWINGS

Similar numbers refer to similar parts throughout the specification.

DETAILED DESCRIPTION OF THE DISCLOSURE

A first exemplary configuration of a container is indicated generally by the numeral 2 in the following description and in the accompanying drawings. The first exemplary configuration of container 2 is used with screen savers sized for mobile phones or tablets. Any dimensions are provided for purposes of example and it is understood that the dimensions of container 2 may change when container 2 is used to hold other items of merchandise. The first exemplary configuration of container 2 is formed from a total of five layers of paperboard material. It is understood that fewer or additional layers of material may be used to change the depth of the storage chamber 4 of container 2 as needed to accommodate the merchandise or as needed depending on the thickness of the material that is used to form container 2.

Figure 6:
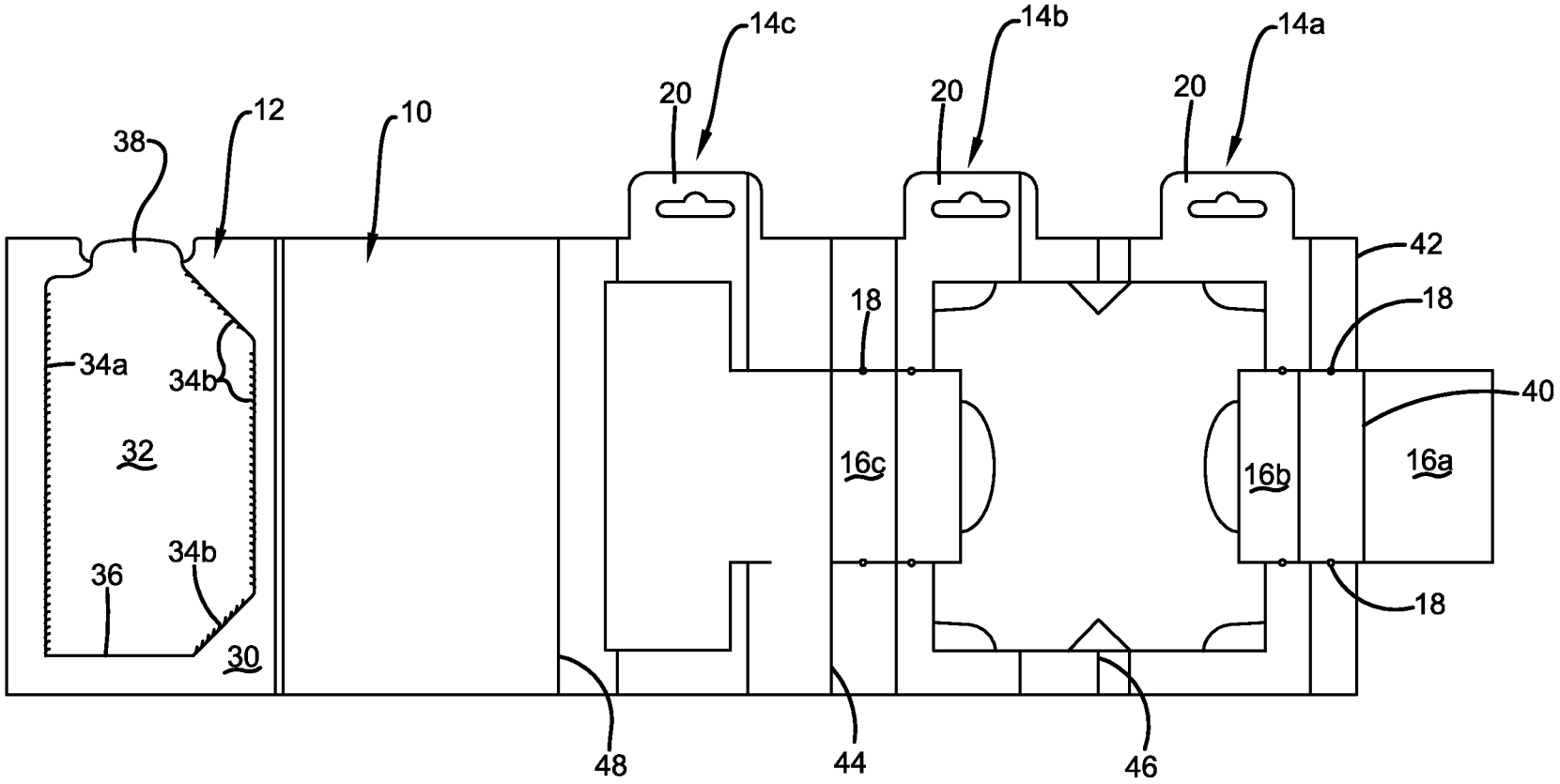
FIG. 6 is a plan view of a blank that may be used to make the exemplary configuration disclosed in these drawings.
Figure 7:
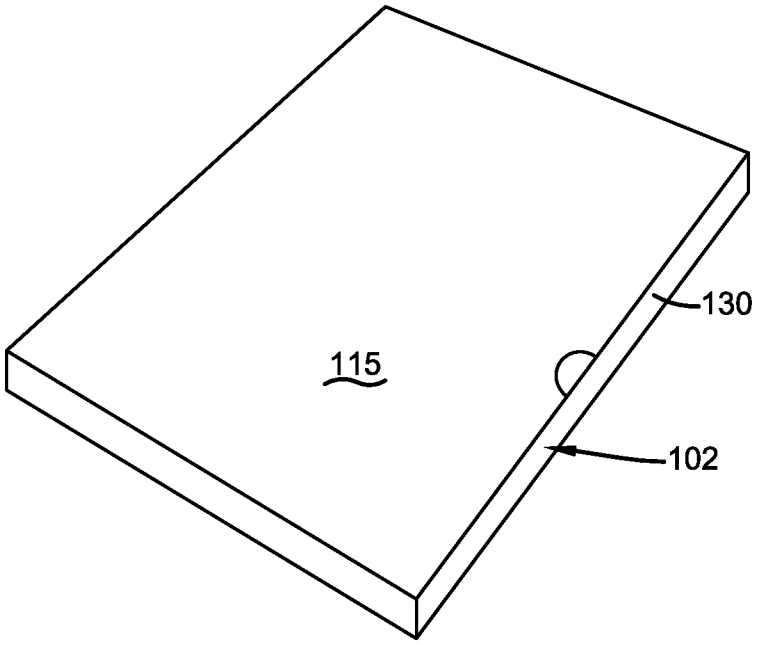
FIG. 7 is a perspective view of another exemplary merchandise storage container disposed in an outer sleeve.
Figure 8:
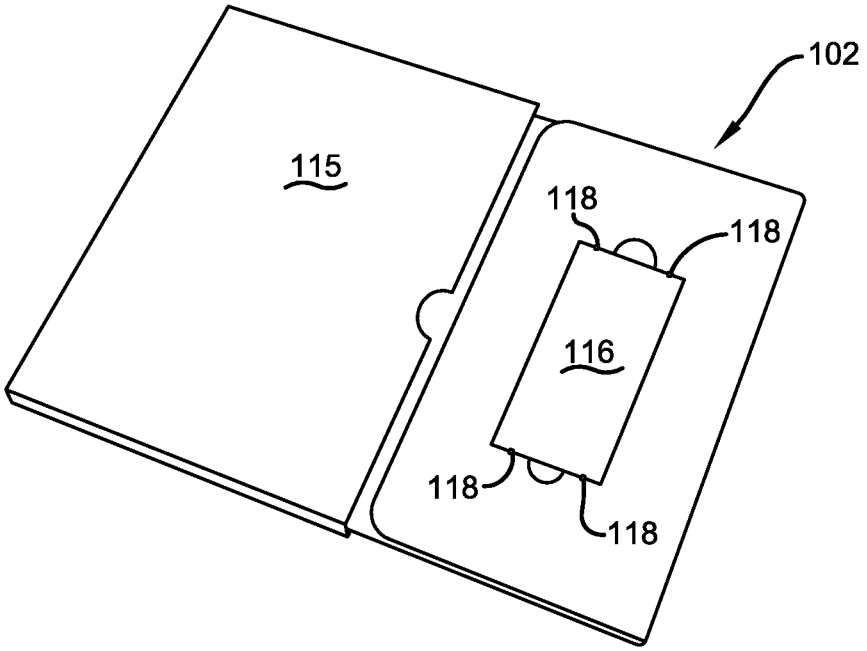
FIG. 8 is a perspective view of the exemplary container of FIG. 7 extended from the sleeve.

Container 2 generally includes a first or front panel 10, a second or rear panel 12, and at least one or a plurality of intermediate panels 14 disposed between first 10 and second 12 panels to define the body of container 2. All of these panels may be formed from a common blank of material that is folded to define the body of container 2. The material for the panels may be 0.024" SBS or 0.018" SBS (solid bleached sulphate paperboard). FIG. 6 depicts one exemplary blank that includes three intermediate panels 14*a*, 14*b*, and 14*c*. Panels 10 and 12 may be connected with a hinge panel disposed between a pair of living hinges. The hinge panel provides space to accommodate all of intermediate panels 14 when container 2 is assembled.

Figure 5:
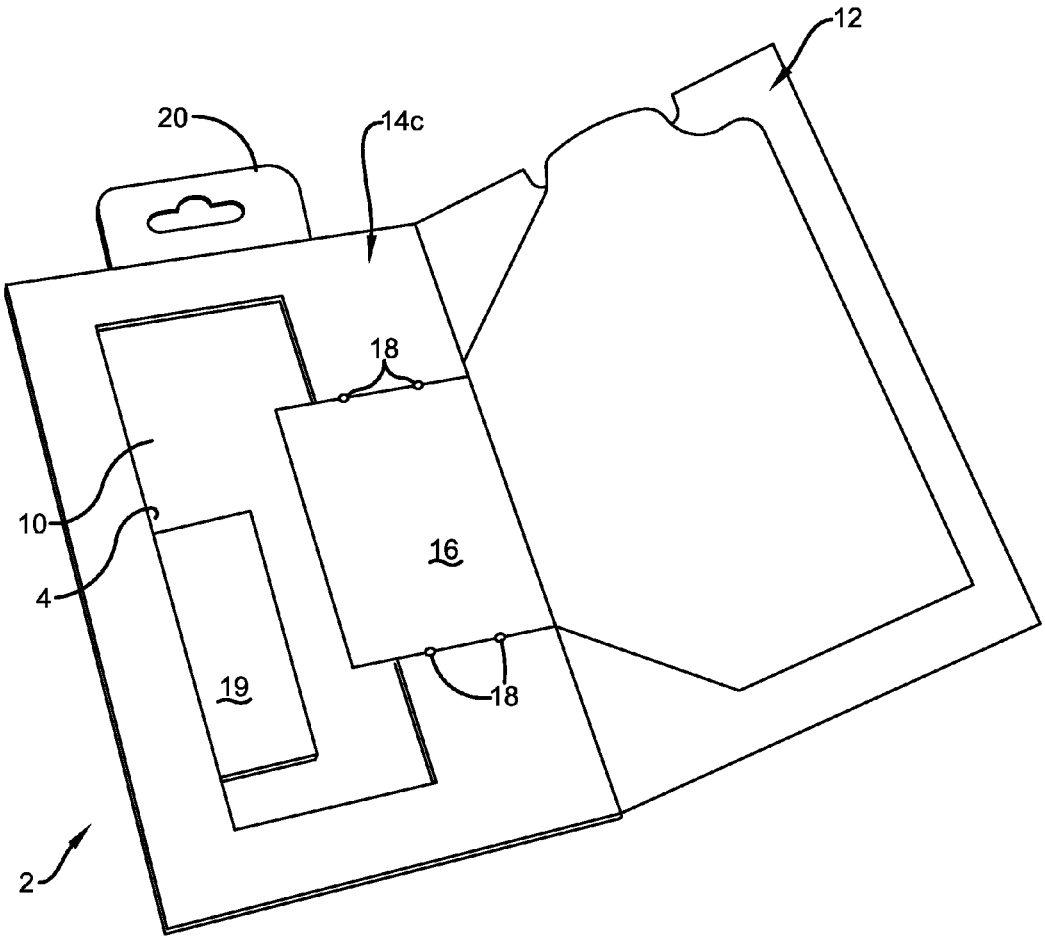
FIG. 5 is a view of the interior of the merchandise storage container before the container is loaded with merchandise and glued closed.

Container 2 includes a tool 16 which is in the form of a rectangular squeegee in this example. Tool 16 is connected to intermediate panels 14 until removed by the end user. In this example, tool 16 is connected to at least one panel 14 with nicks 18 that are destroyed when the user removes tool 16 from container 2. In the example of container 2 that is used with a plurality of screen savers (shown schematically in FIG. 5 at reference numeral 19), having a substantially sealed storage chamber 4 is desired to minimize contaminants on screen savers 19.

An outer surface of first panel 10 is free of interruptions to allow for printing.

A hang tab 20 is formed from cooperating portions of each intermediate panel 14. Hang tab 20 defines an opening that allows container 2 to be displayed from a standard display rod or hook. Hang tab 20 alternatively may extend from first panel 10. The middle portions of each intermediate panel 14 are cut so that they may be removed to form a major portion of storage chamber 4. These portions may be removed individually or after folding as a single removal.

Figure 1:
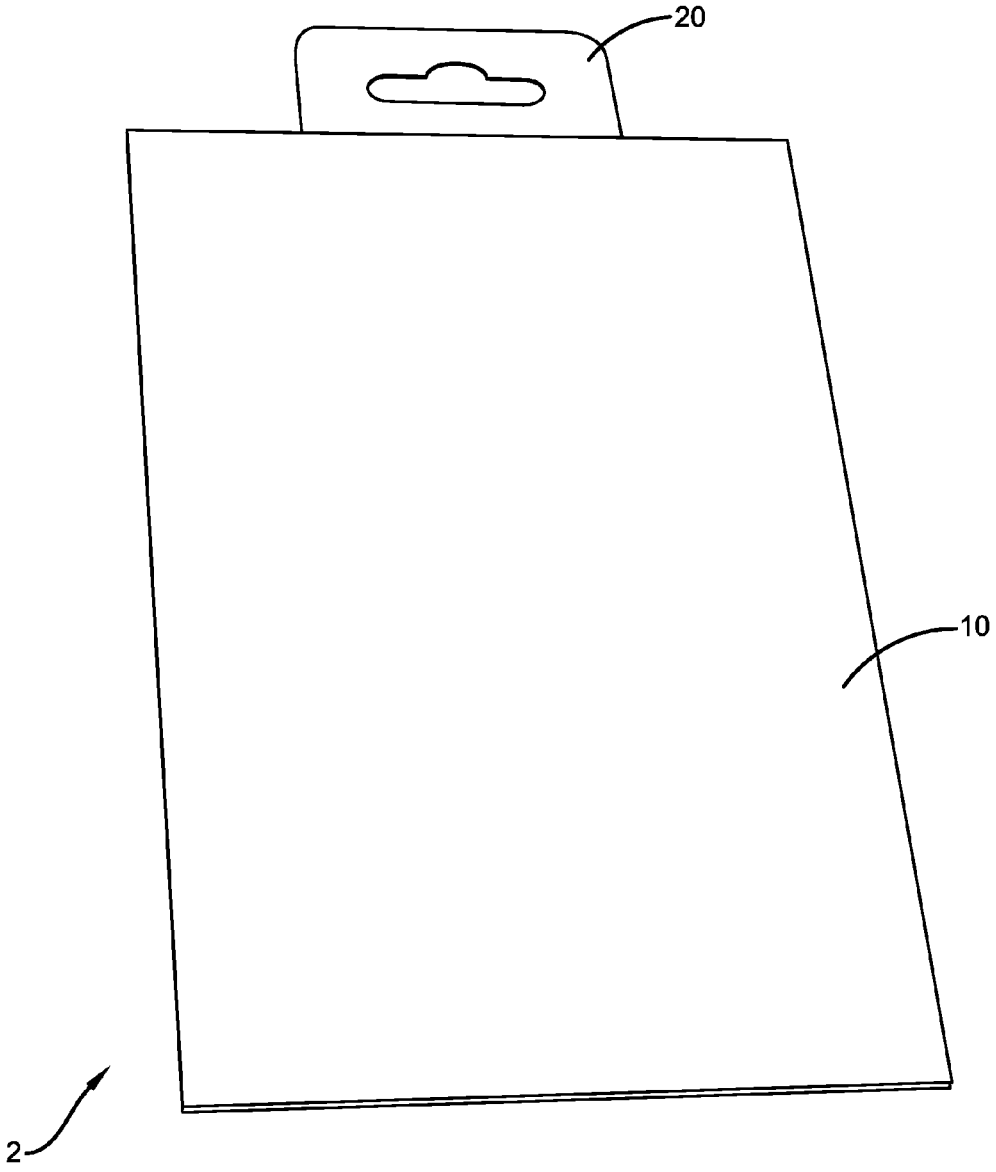
FIG. 1 is a front view of an exemplary merchandise storage container.
Figure 2:
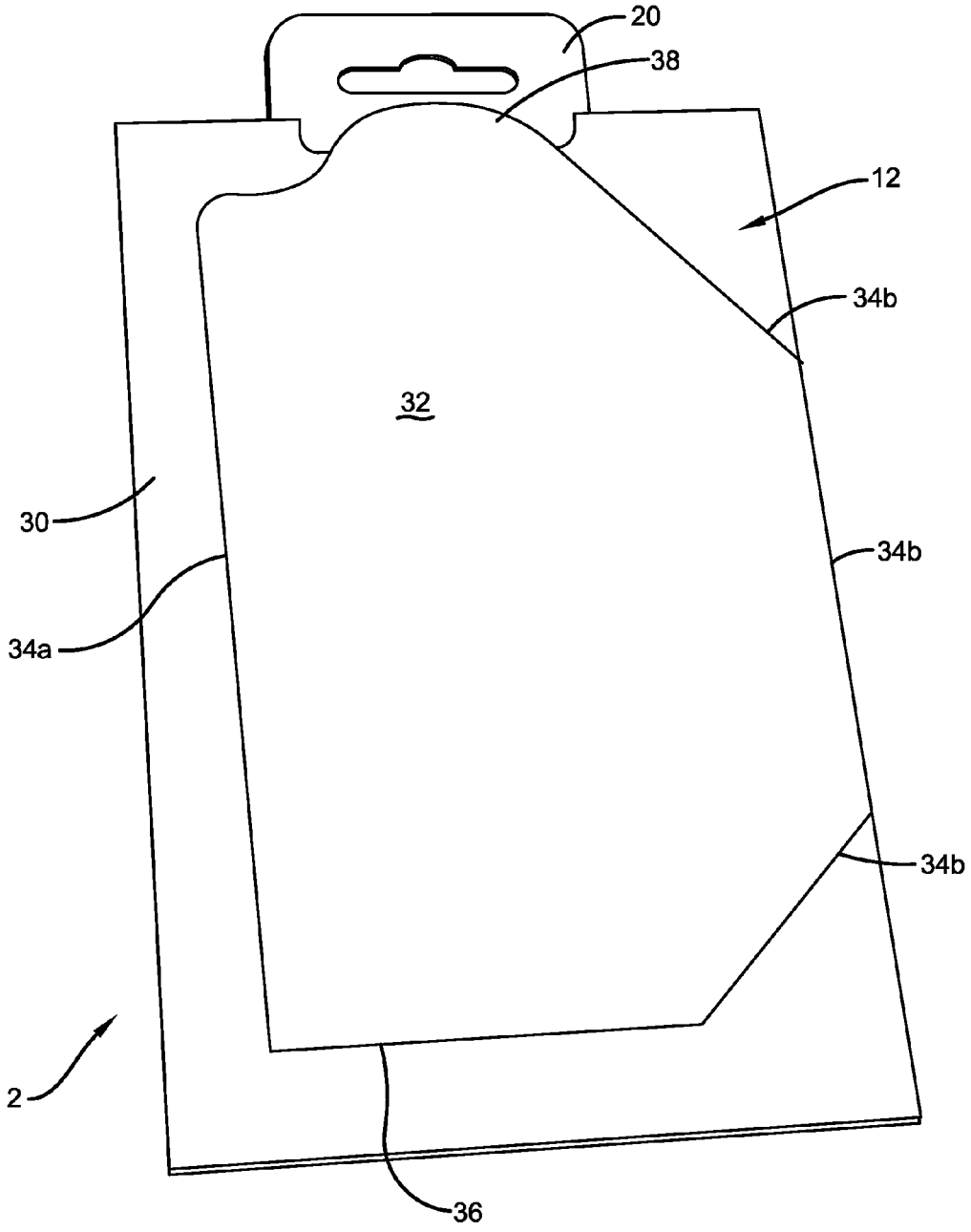
FIG. 2 is a rear view of the exemplary merchandise storage container with the storage chamber access door closed.

Second panel 12 defines a frame 30 and an access door 32 that is defined by at least one perforated or weakened tear line 34 so that the user may tear open access door 32 along line 34 (lines 34*a* and 34*b* may be a single continuous tear line or separate lines) and fold access door down away from frame 30 along a fold line or hinge 36 to expose storage chamber 4 and tool 16 of container 2. In the exemplary configuration, access door 32 is defined by first 34*a* and second 34*b* tear lines that extend up the sides of access door 32 to opposite sides of a gripping tab 38 disposed next to the rear surface of hang tab 20 as shown in FIG. 2. Gripping tab 38 allows the user to grasp access door 32 and pull it down to tear lines 34 to open door 32 about fold line 36. Tear lines 34 are formed by a plurality of cuts and may be provided in a configuration that minimizes paper fibers from contaminating screen savers 19 when lines 34 are torn.

Figure 3:
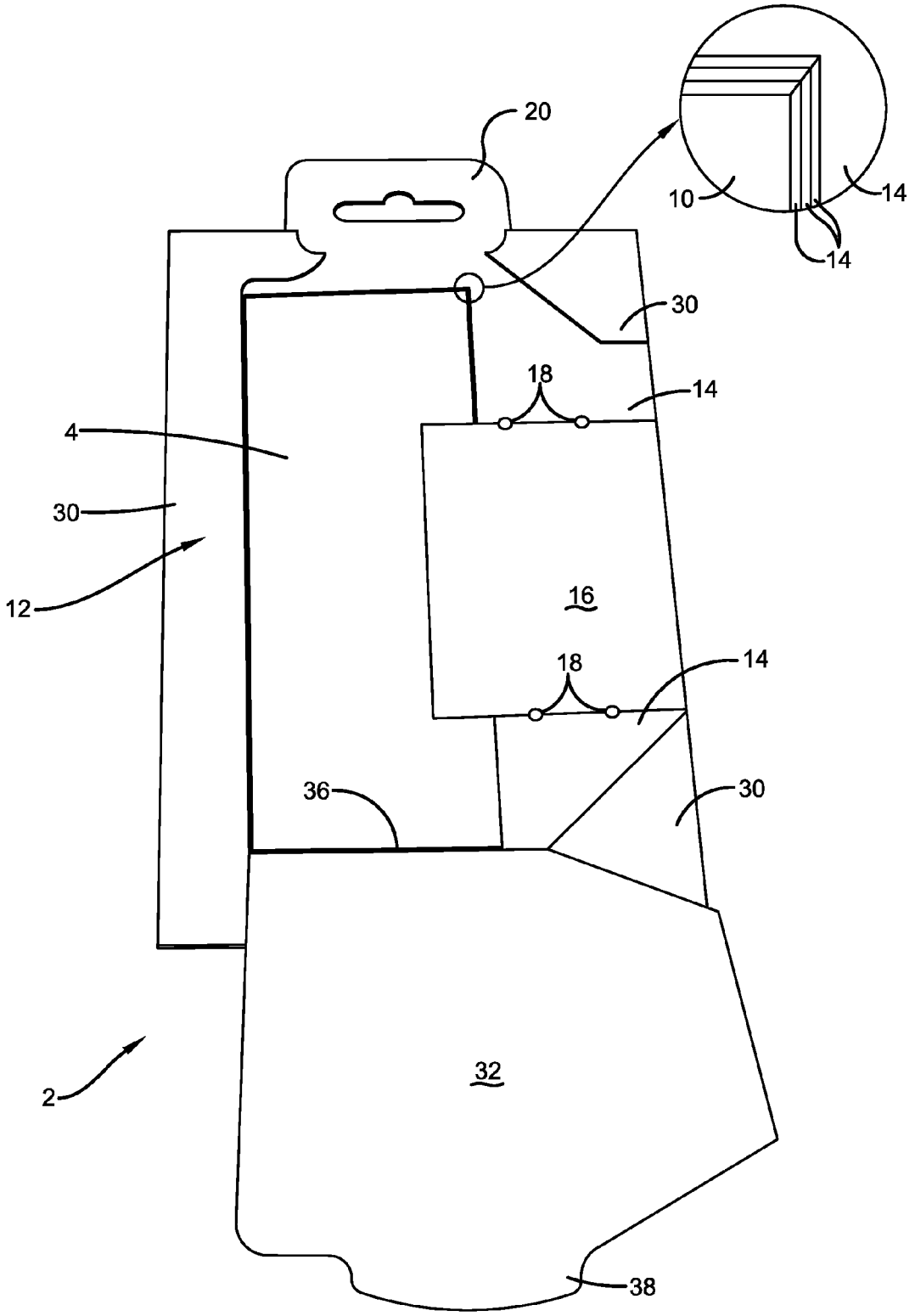
FIG. 3 is a rear view of the exemplary merchandise storage container with the storage chamber access door open and showing the tool still connected to the container wall.
Figure 4:
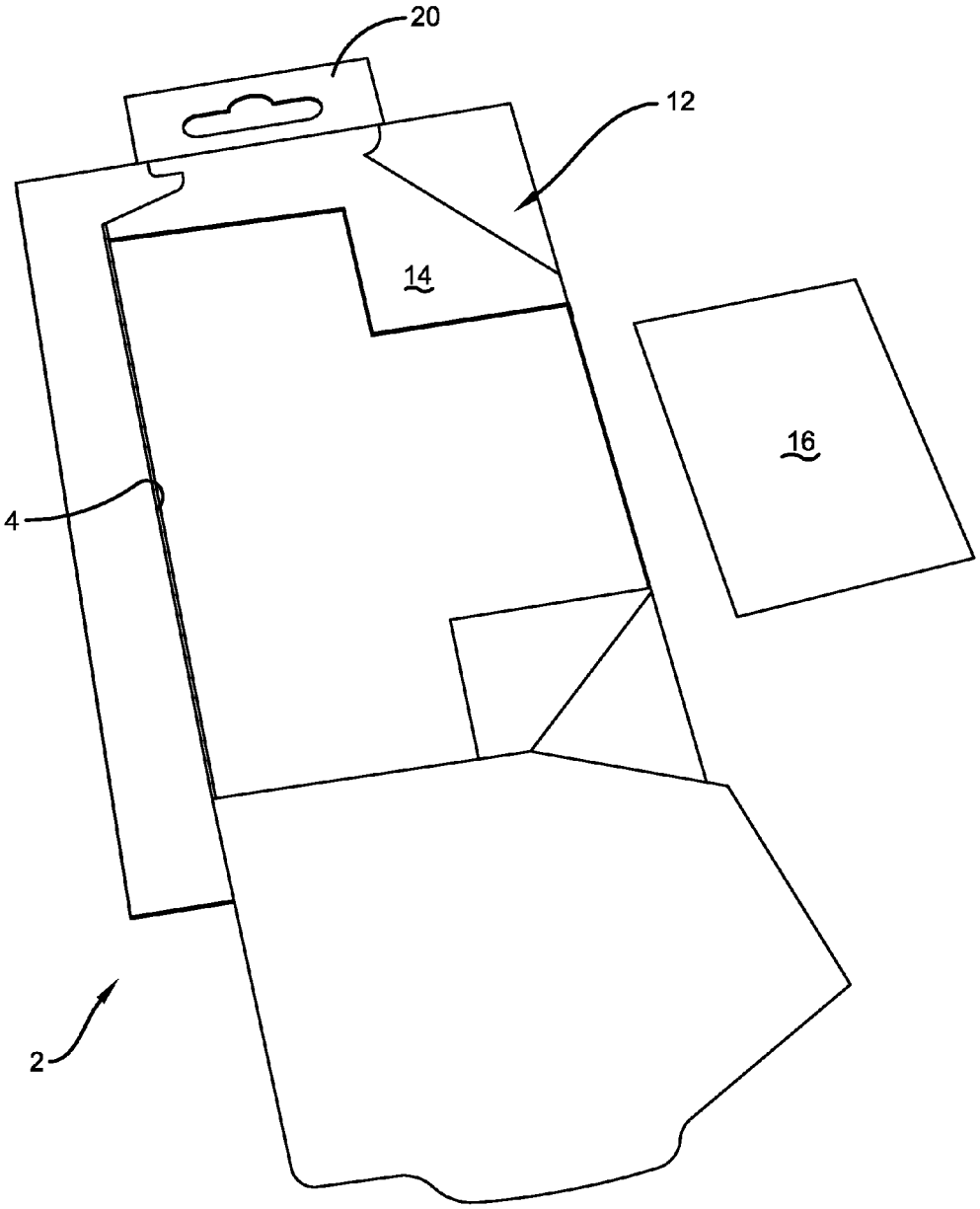
FIG. 4 is view similar to FIG. 3 with the tool detached.

When access door 32 is open as shown in FIG. 3, storage chamber 4 and tool 16 are exposed. Storage chamber 4 may extend under a portion of frame 30 to provide room for the merchandise and so that merchandise that has been tucked under frame 30 does not readily fall out of storage chamber 4 when door 32 is opened. The exposed surface of tool 16 may include written instructions for its removal and use that are now visible to the user of container 2.

Tool 16 is formed from three layers of material 16*a*, 16*b*, and 16*c* as shown in FIG. 6. A first portion 16*a* extends outwardly from intermediate panel 14*a* with its fold line 40 offset from the outer edge 42 of panel 14*a* so that fold line 40 will be aligned with fold line 44 when container 2 is assembled. Tool 16 is formed by folding portion 16*a* onto portion 16*b* about fold line 46. These two joined portions 16*a* and 16*b* are folded about line 46 onto and joined with portion 16*c* when panel 14*a* is folded over panel 14*b* (fold line 46) to define tool 16. Panels 14*a* and 14*b* are then folded over fold line 44 onto panel 14*c* and then all three intermediate panels 14 are folded over fold line 48 and are joined with first panel 10. Second panel 12 is then folded over intermediate panels 14 to trap them between panels 10 and 12 and to position door 32 over chamber 4.

Container 2 is used when the user tears open door 32 to provide access to chamber 4 and tool 16. The user may then separate tool 16 from intermediate panels 14 by tearing nicks 18. The user may then use tool 16 to smooth screen savers 19 onto a screen.

Another exemplary configuration of the container is indicated generally by the numeral 102. The exemplary configuration of container 102 is used with screen savers sized for mobile phones. Any dimensions are provided for purposes of example and it is understood that the dimensions of container 102 may change when container 102 is used to hold other items of merchandise. It is understood that fewer or additional layers of material may be used to change the depth of the storage chamber 104 of container 102 as needed for merchandise or as needed depending on the thickness of the material that is used to form container 102.

Figure 10:
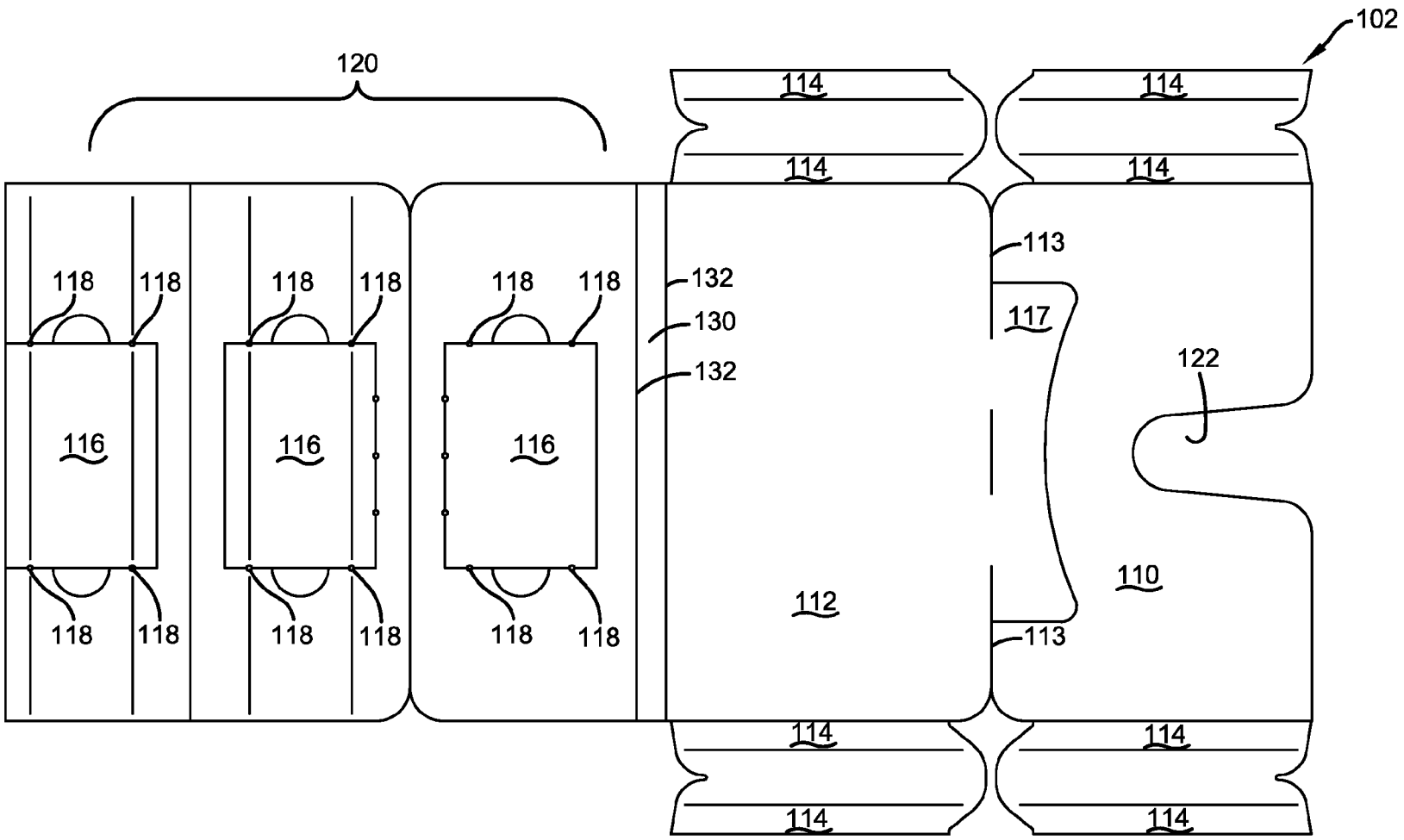
FIG. 10 is a top plan view of a blank used to form the container of FIGS. 7-9.

Container 102 generally includes a first or front panel 110, a second or rear panel 112, and at least one or a plurality of intermediate panels 114 disposed between first 110 and second 112 panels to define storage chamber 104 of container 102. All of these panels may be formed from a common blank of material and then folded with respect to each other to define the body of container 102. The material for the panels may be 0.024" SBS or 0.018" SBS (solid bleached sulphate paperboard). FIG. 10 depicts one exemplary blank that includes eight intermediate panels 114 to define the depth of storage chamber 104. Panels 110 and 112 may be connected with a hinge 113.

Figure 11:
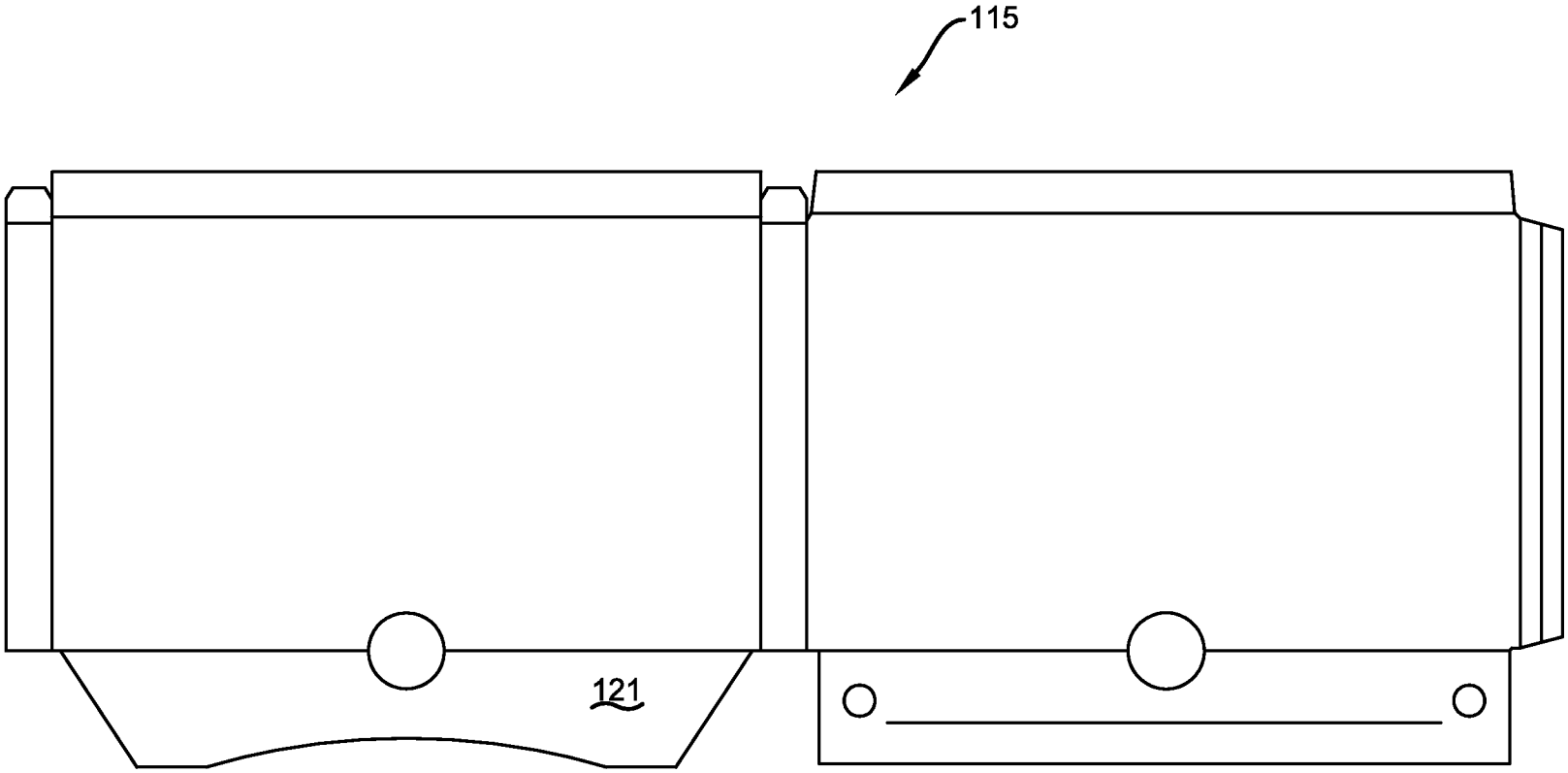
FIG. 11 is a top plan view of a sleeve used with the container of FIGS. 7-9.

When used with an outer sleeve 115, container 102 includes a locking flange 117 that interacts with a corresponding locking flange 121 (FIG. 11) disposed inside sleeve 115 to prevent container 102 from being readily pulled out of sleeve 115.

Figure 9:
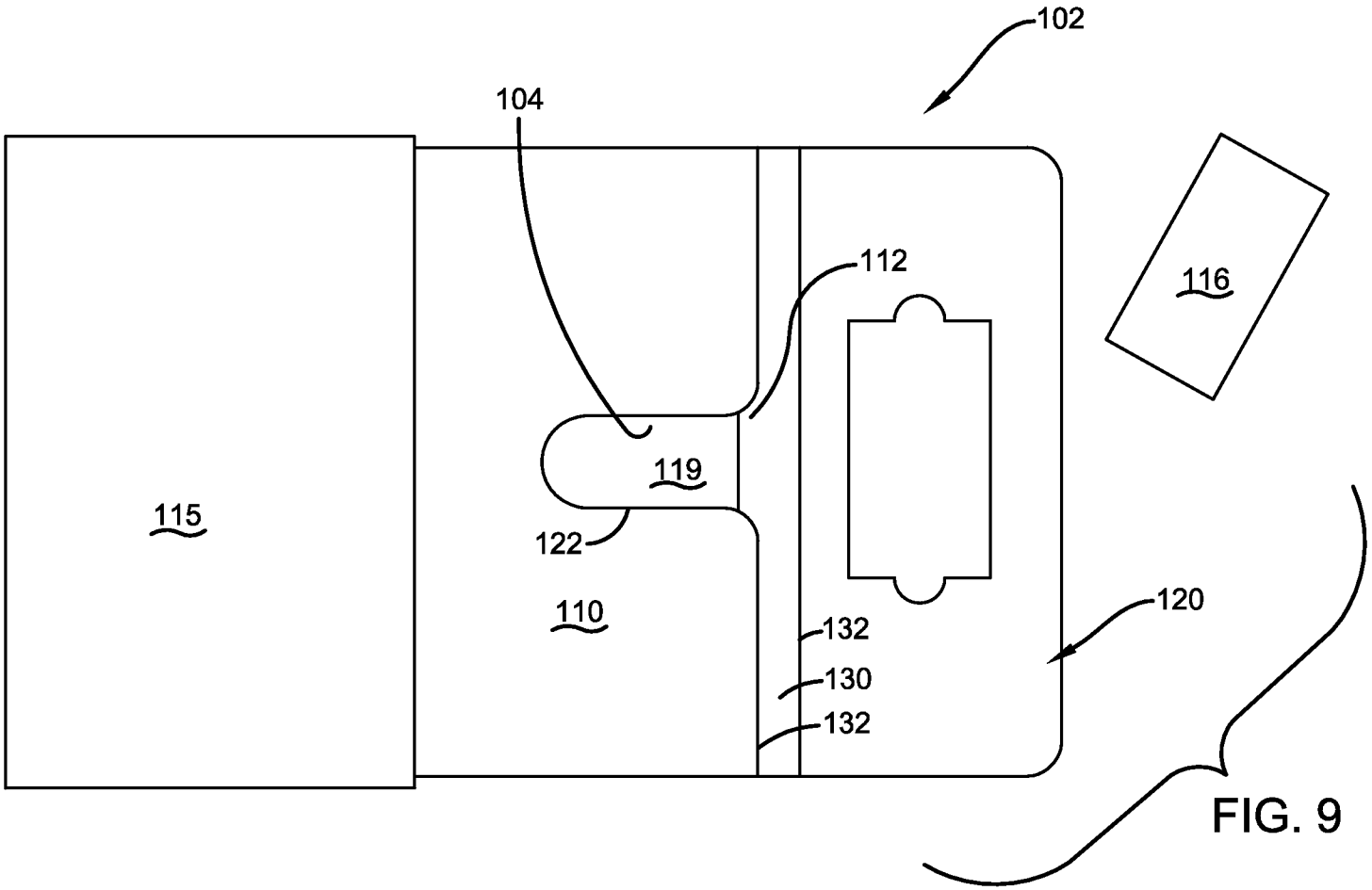
FIG. 9 is a top plan view of the container of FIGS. 7 and 8 in an open configuration with the integrated tool separated from the container.

Container 102 includes a cover or door 120 that pivots over at least a portion of the outer face of first panel 110 when container 102 is closed. Container 102 includes a tool 116 which is in the form of a rectangular squeegee in this example. Tool 116 is connected to door 120 until removed by the end user. In this example, tool 116 is connected to one panel of door 120 with nicks 118 that are destroyed when the user removes tool 116 from container 102. In the example of container 102 used with a plurality of screen savers (shown schematically in FIG. 9 at reference numeral 119), providing a substantially closed storage chamber 104 is desired to minimize contaminants on screen savers 119. First panel 110 may define a finger access notch 122 that allows the user to slide a screen saver 119 out of container 102 when door 120 is open as shown in FIG. 9.

Door 120 is connected to second panel 112 with a hinge wall 130 that is double hinged at 132 to allow door 120 to rest on the front surface of first panel 110.

Tool 116 is formed from three layers of material as shown in FIG. 10. The three layers are formed from three panels of door 120.

Container 102 is used by when the user slides container 102 out of sleeve 115 to allow door 120 to be exposed. The user may then separate tool 116 from door 120 by tearing nicks 118. The user may then use tool 116 to smooth screen savers 19 onto a screen. The user also may pivot door 120 open to the position of FIG. 9 before tool 116 is removed.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the above description and attached illustrations are an example and the invention is not limited to the exact details shown or described. Throughout the description and claims of this specification the words "comprise"

and "include" as well as variations of those words, such as "comprises," "includes," "comprising," and "including" are not intended to exclude additives, components, integers, or steps.

The invention claimed is:

1. A merchandise storage container comprising:

a container body defining a merchandise storage chamber;

a tool integrally formed with and connected to the container body; the tool being adapted to be used with the merchandise stored in the container;

the container body having a closed configuration wherein the tool and storage chamber are fully contained within the container body;

the container body having an open configuration wherein the tool and storage chamber are accessible; and the tool being readily separable from the container body when the container body is in the open configuration; wherein the tool is a squeegee for a flexible screen saver.

2. The container of claim 1, wherein the container body and tool are formed from layers of paperboard.

3. The container of claim 2, wherein the container body includes a door movable from a closed condition to an open condition.

4. A merchandise storage container comprising:

a container body defining a merchandise storage chamber;

a tool integrally formed with and connected to the container body; the tool being adapted to be used with the merchandise stored in the container;

the tool being readily separable from the container body;

the tool being a squeegee for a flexible screen saver;

the container body and tool being formed from layers of paperboard;

the container body including a door movable from a closed condition to an open condition; and the door covering the tool when the door is in the closed condition.

5. The container of claim 4, wherein a portion of the tool extends into the storage chamber.

6. The container of claim 4, wherein the squeegee is secured to the body of the container with a plurality of paperboard nicks.

7. The container of claim 4, wherein the storage chamber of the container body is accessed through a first panel of the container body to allow for easy removal of the merchandise and to provide access to the tool.

8. The container of claim 7, wherein the first panel of the container body defines a frame and the door; the open condition of the door providing access to the storage chamber.

9. The container of claim 8, further comprising a gripping tab extending from door.

10. The container of claim 9, wherein the container body includes a hang tab that defines an opening; the gripping tab of the door being aligned with the hang tab when the door is in the closed condition.

11. The container of claim 8, wherein the frame overhangs a portion of the storage chamber to allow merchandise to be disposed under a portion of the frame.

12. The container of claim 8, wherein at least a portion of the tool extends into storage chamber.

13. The container of claim 8, wherein the first panel is an outer panel and the body including a second outer panel and at least one intermediate panel; the first and second outer panels being connected with a hinge panel disposed between a pair of living hinges; the hinge panel providing space to accommodate the at least one intermediate panel when the container is assembled.

14. A paperboard merchandise storage container having a storage chamber for flexible screen savers; the container comprising:

a container body formed from a plurality of layers of paperboard; the container body defining a storage chamber;

a plurality of flexible screen savers disposed in the storage chamber;

a squeegee integrally connected with the container body; the squeegee being made from the same layers of paperboard that define the container body;

the container body having a closed configuration wherein the squeegee and flexible screen savers are inaccessible and fully contained within the container;

the container body having an open configuration wherein the squeegee and flexible screen savers are accessible; and the squeegee being separable from the container body after the user accesses the screen savers so that the user has a squeegee ready for the installation of the screen savers on a screen.

15. The container of claim 14, wherein the container body includes a first outer panel that defines a frame and a door disposed within the frame; the door being movable from a closed condition to an open condition; the open condition of the door providing access to the storage chamber.

16. The container of claim 15, wherein the door covers the squeegee when the door is in the closed condition.

* * * * *